US005990773A

United States Patent [19]

Sengoku

[11] Patent Number: 5,990,773

[45] Date of Patent: Nov. 23, 1999

[54] THERMAL SWITCH DEVISE COMPRISING REED SWITCH AND TEMPERATURE-SENSITIVE MAGNETIC STRUCTURE SUPPORTED IN AND OUT, RESPECTIVELY, OF AN INNER CYLINDER OF CASE

[75] Inventor: Takeshi Sengoku, Miyagi, Japan

[73] Assignee: Tokin Corporation, Miyagi, Japan

[21] Appl. No.: 09/164,794

[22] Filed: Oct. 1, 1998

[30] Foreign Application Priority Data

Oct. 2, 1997 [JP] Japan ..... 9-288023

[51] Int. Cl.[6] ..... H01H 9/00

[52] U.S. Cl. ..... 335/208; 335/151; 335/153; 335/207

[58] Field of Search ..... 335/141, 146, 335/151, 152, 153, 154, 207, 208, 217

[56] References Cited

U.S. PATENT DOCUMENTS

| | | | |
|---|---|---|---|
| 3,295,081 | 12/1966 | Bowyer et al. | 335/208 |
| 3,390,362 | 6/1968 | Hoeppel | 335/153 |
| 3,890,586 | 6/1975 | Krause | 335/208 |
| 4,509,029 | 4/1985 | Bradley | 335/208 |

FOREIGN PATENT DOCUMENTS

| | | |
|---|---|---|
| 0856864 | 8/1998 | European Pat. Off. . |
| 02256125 | 10/1990 | Japan . |
| 08329807 | 12/1996 | Japan . |

*Primary Examiner*—Lincoln Donovan
*Assistant Examiner*—Raymond Barrera

[57] ABSTRACT

In a thermal switch device having a reed switch, a temperature-sensitive magnetic cylinder (1) and cylindrical permanent magnets (2*a*, 2*b*) disposed around the reed switch (3), and an insulator case (7), the case is provided with an inner cylinder (5) formed in an inner space of the case. The reed switch is supported in the inner cylinder, and the temperature-sensitive magnetic cylinder and the cylindrical permanent magnets are fitted on the inner cylinder. A heat conductor member (6) is attached to the case to be partially exposed outside the case while partially be in contact with the temperature-sensitive magnetic cylinder and the cylindrical permanent magnets.

6 Claims, 3 Drawing Sheets

THERMAL SWITCH DEVISE COMPRISING REED SWITCH AND TEMPERATURE-SENSITIVE MAGNETIC STRUCTURE SUPPORTED IN AND OUT, RESPECTIVELY, OF AN INNER CYLINDER OF CASE

BACKGROUND OF THE INVENTION

This invention relates to a thermal switch device comprising a thermal reed switch assembly and an insulator case containing the thermal switch assembly, and in particular, to a mounting structure of the thermal reed switch assembly into the case.

A thermal switch device is well known in the art which comprises a thermal reed switch assembly contained in an insulator body. The thermal reed switch assembly comprises a reed switch having a pair of reeds and a temperature-sensitive magnetic structure mounted on the reed switch. The temperature-sensitive magnetic structure comprises at least one temperature-sensitive magnetic ring or cylinder and at lest one cylindrical permanent magnet. The temperature-sensitive magnetic ring has a Curie point at a desired temperature, and exhibits magnetism and paramagnetism at lower and higher temperatures than the Curie point, respectively. Therefore, the temperature variation of the temperature-sensitive magnetic ring around the Curie point changes flow of the magnetic flux of the permanent magnet through the paired reeds of the reed switch to control ON/OFF operation of the reed switch. Thus, the circumferential temperature of the thermal reed switch assembly can be detected as the ON/OFF state of the reed switch.

In a conventional structure of a thermal switch device of the type as described above, the thermal reed switch assembly is contained in an insulator body of such as synthetic or plastic resin as molded by the mold-in process. A lead frame is connected to the paired reeds before the molding operation. A frame portion of the lead frame is cut out after completion of the molding operation. Thus, two lead conductors or pieces are led out of the insulator body and are connected to the reeds, respectively.

The provision of the lead frame results in an unstable positioning of the reed switch assembly in a mold during the molding operation. This makes it difficult to produce the thermal switch device having a constant thickness of the insulator body surrounding the thermal reed switch assembly. Accordingly, it is difficult to produce the thermal switch devices having a constant temperature-sensitive characteristics.

SUMMARY OF THE INVENTION

It is therefore an object of this invention to provide a thermal switch device which can be easily produced with a constant temperature-sensitive characteristics.

It is another object of this invention to provide a thermal switch device without use of lead frame, thus with a decreased number of parts and producing time.

According to this invention, there is provided a thermal switch device having a reed switch, a cylindrical temperature-sensitive magnetic structure disposed around said reed switch, and an insulator case containing the reed switch and the cylindrical temperature-sensitive magnetic structure, wherein said insulator case is provided with an inner cylinder formed in an inner space of said case, said reed switch is supported in said inner cylinder, and said cylindrical temperature-sensitive magnetic structure is fitted on said inner cylinder.

DESCRIPTION OF PREFERRED EMBODIMENT

Prior to description of a preferred embodiment of this invention, the conventional thermal switch device will be described for the sake of the better understanding of this invention.

Figure 1:
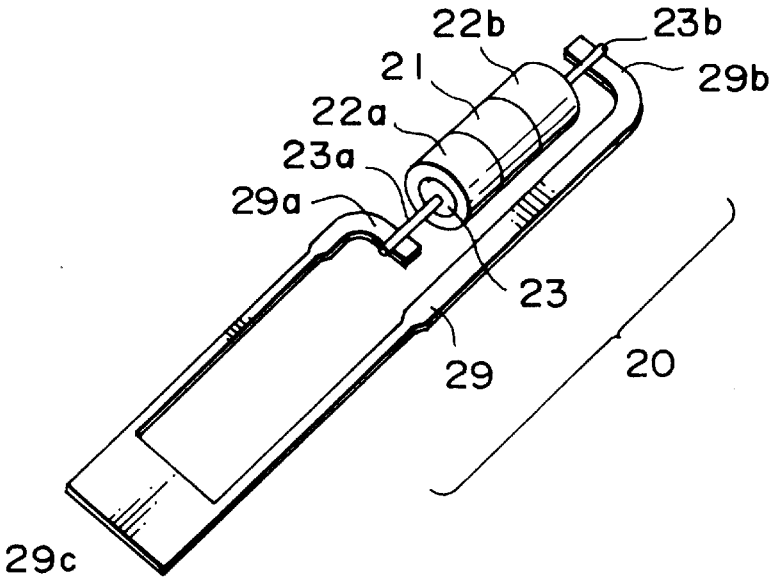
FIG. 1 PRIOR ART
FIG. 1 is a perspective view of a conventional thermal reed switch assembly.
Figure 2:
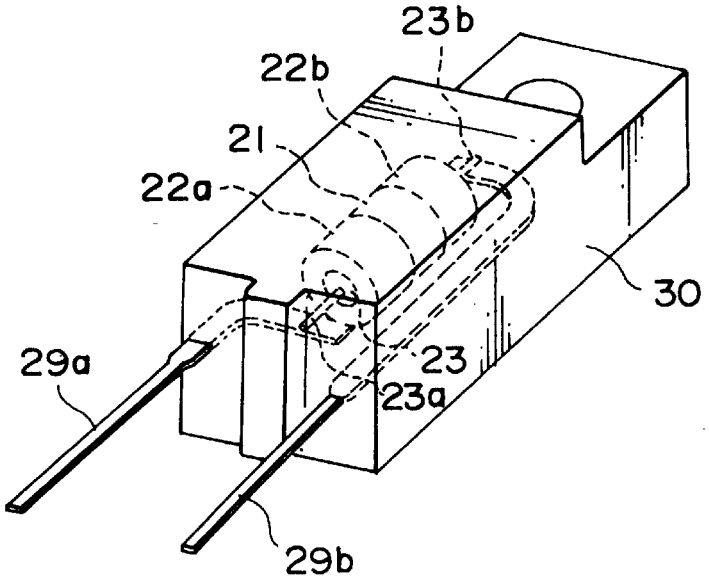
FIG. 2 PRIOR ART
FIG. 2 is a perspective view of a conventional thermal switch device containing the thermal reed switch assembly of FIG. 1.

Referring to FIGS. 1 and 2, the conventional thermal switch device comprises a thermal reed switch assembly 20 and a molded body 30 of plastic resin containing the assembly 20 therein. The thermal reed switch assembly 20 typically comprises a reed switch 23 having a pair of reeds 23*a* and 23*b*, a temperature-sensitive magnetic cylinder 21 mounted on the reed switch 23, a pair of cylindrical permanent magnets 22*a* and 22*b* mounted at both sides of the temperature-sensitive magnetic cylinder 21 on the reed switch 23, and a lead frame 29 connected to the reeds 23*a* and 23*b* at end portions of lead pieces 29*a* and 29*b* of the lead frame 29, respectively.

After the molded body 30 is formed with the thermal reed switch assembly 20 being molded therein but a frame portion 29*c* of the lead frame 29 being projected out of the molded body, the frame portion 29*c* is cut out to remain a pair of lead pieces 29*a* and 29*b* connected to the reeds 23*a* and 23*b*, respectively.

The conventional thermal switch device has problems as described in the preamble.

Referring now to FIGS. 3, 4, 5, and 6, the description will proceed to a thermal switch device according to a preferred embodiment of this invention.

The thermal switch device comprises a temperature-sensitive magnetic cylinder 1, a pair of cylindrical permanent magnets 2*a* and 2*b*, a reed switch 3 having a pair of reeds 3*a* and 3*b*, a signal lead wire 4, a cylinder 5, a heat conductor member 6 made of aluminum and the like, a case 7 of plastic resin having an open end, and a cap 8 of plastic resin closing the open end of the case 7.

The case 7 has an inner space 7*a* in which an inner cylinder 5 is formed. The inner cylinder 5 is cantilevered at the other closed end of the case 7 and projects therefrom to extend in the inner space 7*a* towards the open end.

Figure 3:
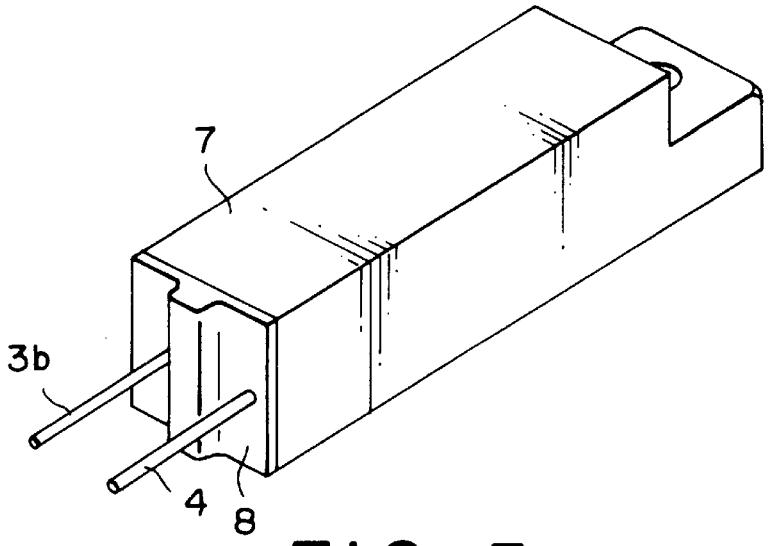
FIG. 3 is a perspective view of a thermal switch device according to an embodiment of this invention.
Figure 4:
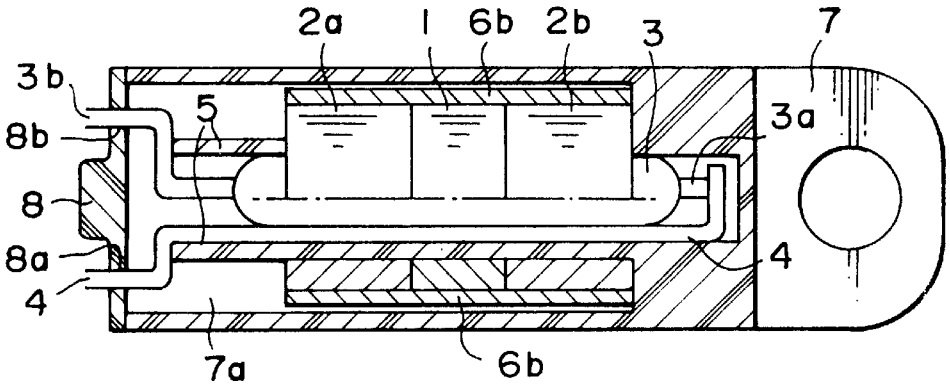
FIG. 4 is a horizontal sectional view of the thermal switch device of FIG. 3.
Figure 5:
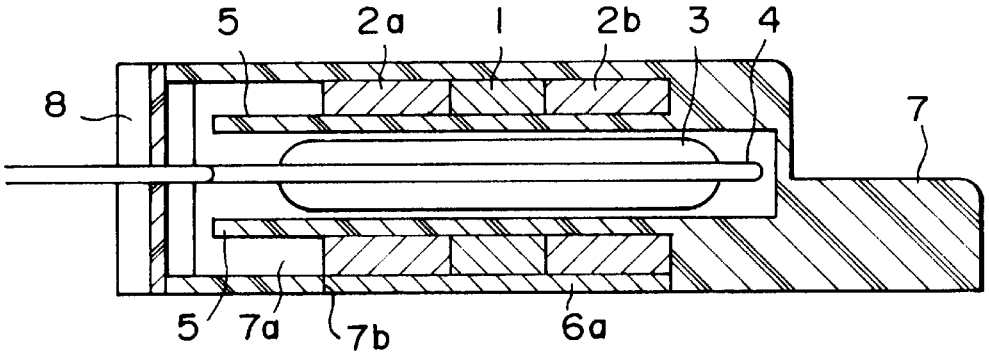
FIG. 5 is a vertical sectional view of the thermal switch device of FIG. 3.

The reed 3*a* of the reed switch 3 is connected to the signal lead wire 4. The reed switch 3 is inserted in the inner cylinder 5 of the case 7 together with the signal lead wire 4. Thus, the reed switch 3 and the signal lead wire 4 are accommodated in the inner cylinder 5 with the reed 3*a* being positioned at the closed end of the case 7 while the other reed 3*b* being led out through the open end. The signal lead wire 4 extends through the inner cylinder 5 and is led out through the open end. When the cap 8 is fitted to the case 7, the signal lead wire 4 and the reed 3*b* are led out of the case closed by the cap through holes 8*a* and 8*b* formed in the cap 8, as shown in FIG. 3.

The temperature-sensitive magnetic cylinder 1 and the permanent magnets 2*a* and 2*b* are fitted on and disposed around the inner cylinder 5, and the permanent magnets 2*a* and 2*b* are arranged on either side of the temperature-sensitive magnetic cylinder 1. Thus, the temperature-sensitive magnetic cylinder 1 and the permanent magnets 2*a* and 2*b* form a cylindrical temperature-sensitive magnetic structure on the inner cylinder 5.

Figure 6:
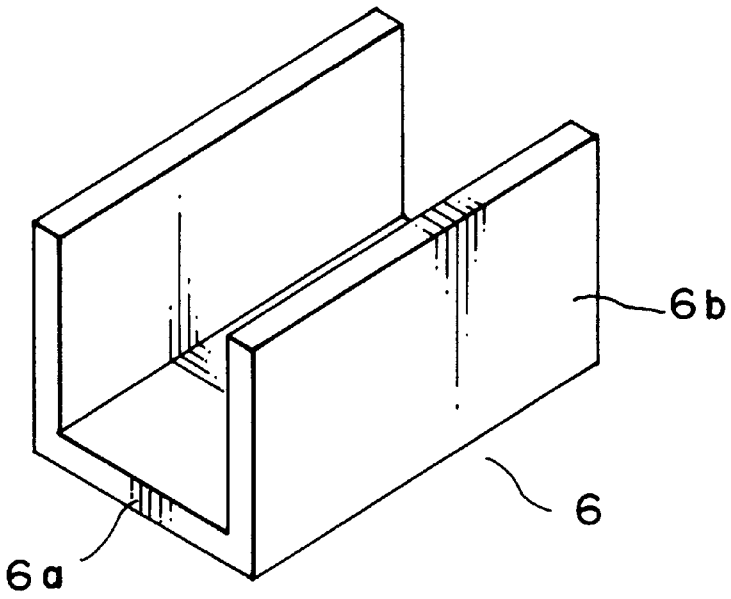
FIG. 6 is a perspective view of a heat conductor member used in the thermal switch device of FIG. 3.
Figure 7:
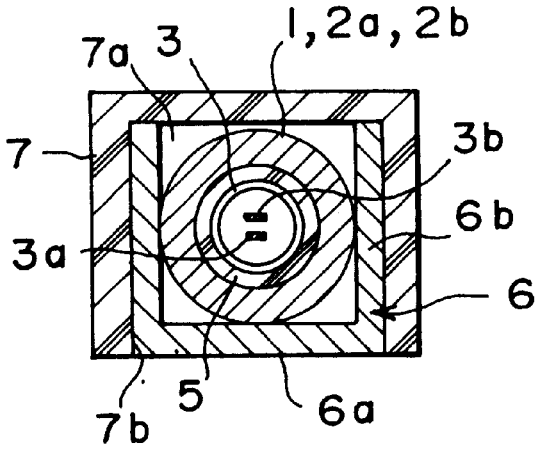
FIG. 7 is a cross-sectional view of the thermal switch device of the FIG. 3.

The heat conductor member 6 has a generally U-shape section and comprises a bottom plate 6*a* and a pair of side plates 6*b* and 6*b*, as shown in FIG. 6. The bottom plate 6*a* of the heat conductor member 6 is inserted into the case 7 through an opening 7*b* which is formed in the bottom of the case 7. The heat conductor 6 is closely fitted into the opening 7*b* and the bottom plate 6*a* of the heat conductor member 6 constitutes a portion of the bottom of the case 7. The bottom plate 6*a* and the side plates 6*b* and 6*b* of the heat conductor member 6 come in contact with the outside of the temperature-sensitive magnetic cylinder 1 and the permanent magnets 2*a* and 2*b*, respectively, as shown in FIG. 7.

In the structure of the thermal switch device in FIGS. 3–7, the temperature-sensitive magnetic cylinder 1 and the permanent magnets 2*a* and 2*b* are regulated in position by the inner cylinder 5, so that they are at a constant distance from the bottom of the case 7. Further, the temperature-sensitive magnetic structure is in contact with the heat conductor member 6 which constitutes a portion of the bottom surface of the case 7. Therefore, heat of an object on which the thermal switch device is mounted can equally and smoothly transmitted to the temperature-sensitive magnetic cylinder 1 and the permanent magnets 2*a* and 2*b*. Therefore, the thermal switch device has an excellent temperature responsibility.

Moreover, the temperature-sensitive magnetic structure and the signal lead wire 4 are insured a sufficient insulating distance by the inner cylinder 5 which supports them.

Further, the thermal switch device does not use any lead frame, but the reed 3*a* of the reed switch 3 connects to the signal lead wire 4, and the signal lead wire 4 and the reed 3*b* are led out through the holes 8*a* and 8*b* formed in the cap 8, respectively. Consequently, the number of parts and manufacturing time decrease.

In the above-mentioned embodiment, the thermal reed switch assembly is shown of a normally closed type where the reed switch is in a ON-state at a normal temperature lower than the Curie point of the temperature-sensitive magnetic member but turns off when the circumferential temperature rises above the Curie point.

But this invention can be adapted to a thermal switch device of another normally open type.

What is claimed is:

1. A thermal switch device comprised of a cylindrical enclosure having a reed switch axially supported therein formed of a pair of reeds with tips thereof extending towards each other from opposite ends of said enclosure with said tips in overlapping contactable relationship with each other;

said thermal switch device comprising a cylindrical temperature-sensitive magnetic structure disposed around said reed switch and confined within an insulator case, said insulator case being provided with an inner-cylinder formed within an inner space of said case, said reed switch being supported in said inner cylinder with said cylindrical temperature-sensitive magnetic structure disposed on said inner cylinder and surrounding said reeds, one of said reeds being connected to a lead wire which is led out of said insulator case, said case having an open end closed by a cap with openings therein, through one opening therein is led a reed and through another opening of which is lead said lead wire, said inner cylinder being cantilevered by a wall of said case at an opposite end thereof and extends towards said open end of said case, said lead wire at the connection to said one reed is adjacent to an inner wall of said device and extends into said inner cylinder towards said cap which thermal switch device further has a heat conductor member inserted into said inner space of said case and in contact with said cylindrical temperature sensitive magnetic structure, a portion of said heat conductor member is exposed in a mounting surface of said case to come into contact with an object on which said thermal switch device is mounted.

2. A thermal switch device as claimed in claim 1, wherein said case has an opening in its bottom wall, and said heat conductor member is closely fitted into said inner space of said case.

3. A thermal switch device as claimed in claim 2, wherein said heat conductor member is in a form of a U-shape box.

4. A thermal switch device as claimed in claim 2, wherein said heat conductor member is made of aluminum.

5. A thermal switch device as claimed in claim 1, wherein said cylindrical temperature-sensitive magnetic structure comprises at least one temperature-sensitive magnetic cylinder, and at least one cylindrical permanent magnet.

6. A thermal switch device as claimed in claim 1, wherein said cylindrical temperature-sensitive magnetic structure comprises a temperature-sensitive magnetic cylinder, and two cylindrical permanent magnets disposed at both sides of said temperature-sensitive magnetic cylinder.

* * * * *